US005829171A

United States Patent [19]

Weber et al.

[11] Patent Number: 5,829,171

[45] Date of Patent: Nov. 3, 1998

[54] CUSTOM-FITTING FOOTWEAR

[75] Inventors: William H. Weber, Novelty; James W. Hoover, Akron, both of Ohio

[73] Assignee: Perfect Impression Footwear Company, Cleveland, Ohio

[21] Appl. No.: 777,471

[22] Filed: Dec. 30, 1996

[51] Int. Cl.[6] ..... A43B 7/14; A43B 7/02; A43B 13/38

[52] U.S. Cl. ..... 36/93; 36/2.6; 36/44

[58] Field of Search ..... 36/2.6, 93, 44, 36/153, 154

[56] References Cited

U.S. PATENT DOCUMENTS

| | | |
|---|---|---|
| 1,508,110 | 9/1924 | Mayer . |
| 3,221,353 | 12/1965 | Greene . |
| 3,493,986 | 2/1970 | Erwin . |
| 3,641,688 | 2/1972 | von den Benken . |
| 3,835,558 | 9/1974 | Revill . |
| 3,896,516 | 7/1975 | von den Benken . |
| 3,968,577 | 7/1976 | Jackson . |
| 4,055,699 | 10/1977 | Hsiung . |
| 4,128,951 | 12/1978 | Tansill . |
| 4,296,053 | 10/1981 | Doerer et al. . |
| 4,433,494 | 2/1984 | Couvoisier et al. . |
| 4,674,199 | 6/1987 | Lakic . |
| 4,823,420 | 4/1989 | Bartneck . |
| 4,901,390 | 2/1990 | Daley . |
| 4,910,881 | 3/1990 | Baggio et al. . |
| 4,953,309 | 9/1990 | Kaiser . |
| 5,003,708 | 4/1991 | Daley . |
| 5,063,690 | 11/1991 | Slenker . |
| 5,123,180 | 6/1992 | Nannig et al. . |
| 5,150,490 | 9/1992 | Busch et al. . |
| 5,319,867 | 6/1994 | Weber . |
| 5,499,460 | 3/1996 | Bryant et al. . |
| 5,548,848 | 8/1996 | Huybrechts . |
| 5,555,584 | 9/1996 | Moore, III et al. . |

OTHER PUBLICATIONS

Watlow Catalog, "Flexible Heaters", pp. 143–144, Dated prior to Oct. 1996.

*Primary Examiner*—Ted Kavanaugh
*Attorney, Agent, or Firm*—Pearne, Gordon, McCoy and Granger LLP

[57] ABSTRACT

Footwear such as a shoe or boot has an upper, an outsole and an insole. The insole comprises a layer of thermoplastic material and a heater member. The heater member is capable of generating heat by being energized by electrical energy and is capable upon being energized of effectively heating and softening the thermoplastic material so that the insole may be conformed to the shape of the underside of a foot of a person, in order to provide a custom-fitting footbed and custom-fitting footwear. The heater member preferably includes an etched foil heating element which heats by electrical resistance.

26 Claims, 4 Drawing Sheets

Fig.4
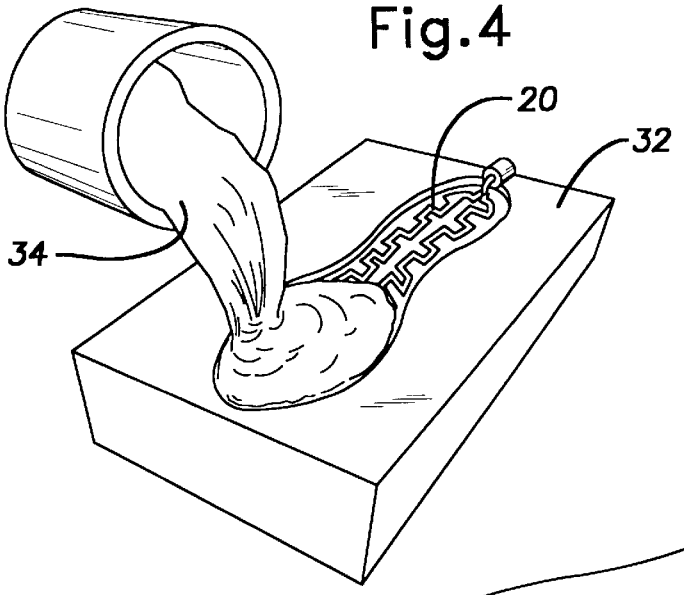
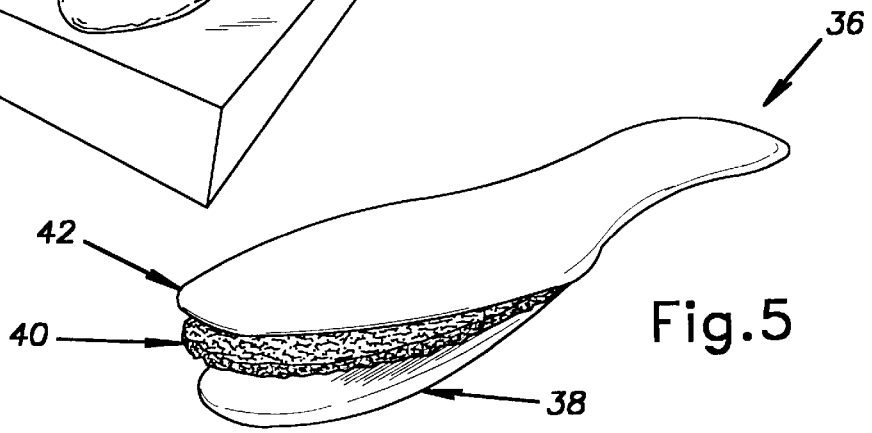
Fig.5
Fig.7
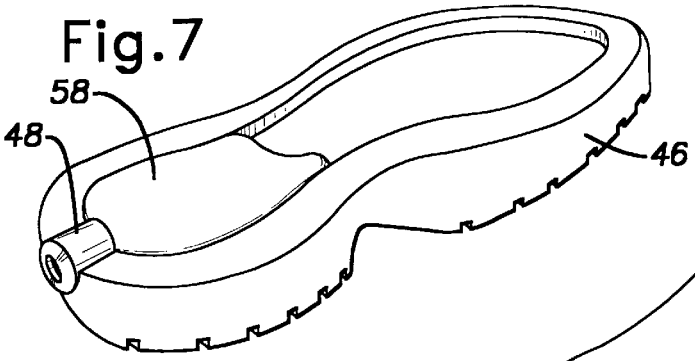
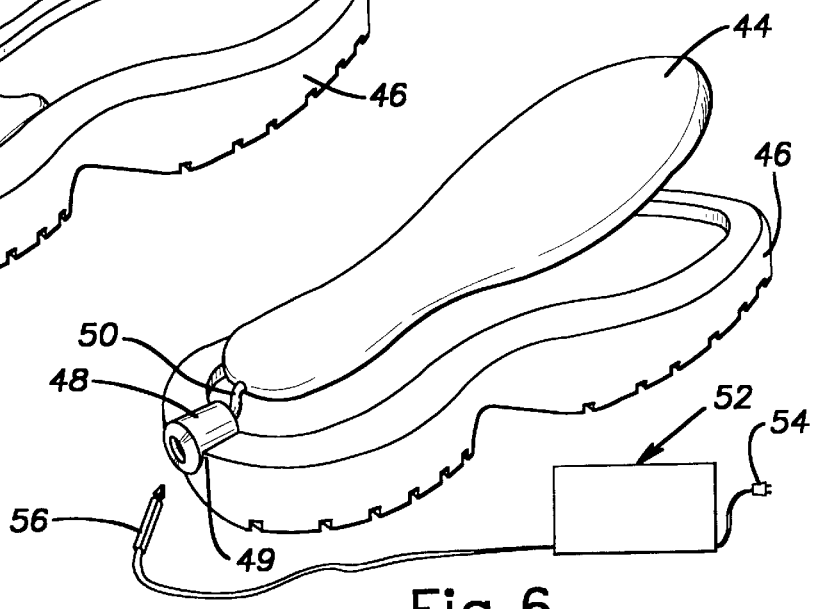
Fig.6

CUSTOM-FITTING FOOTWEAR

CROSS-REFERENCE TO RELATED APPLICATION

This application claims the benefit of U.S. Provisional Application No. 60/027,175, filed Oct. 1, 1996.

BACKGROUND OF THE INVENTION

1. Field of the Invention

The present invention relates generally to custom-fitting footwear and more specifically to a conformably moldable thermoplastic insole in footwear which is heat-softenable by a built-in electric heater member.

2. Description of Related Art

For many years removable and non-removable insoles for footwear have been produced to simulate the bottom contour of the human foot in an effort to provide the wearer with a greater degree of comfort, supporting the arches and reducing the shock of impact while walking, running or jumping. A number of approaches have been taken to provide insoles which have a shape custom-fitted to the individual shape of the underside of a particular wearer's foot. In one approach, different chemicals are mixed and a chemical reaction is initiated in an insole, the person then steps into the footwear having the insole therein and forms an impression and the material is allowed to cure before the footwear is used. See U.S. Pat. Nos. 4,520,581; 4,128,951; 2,838,776; and 4,888,225. U.S. Pat. No. 3,968,577 discloses a similar system where the curing may also be via heating. However, in these processes if the fit is not right the first time, the insole cannot be remolded and must be discarded.

Other references disclose an insole having a layer of a thermoplastic material. The thermoplastic material is heated, thus softening it. The person steps into the footwear and makes an impression in the insole. The material then cools, retaining the impression of the foot. A custom-fitting insole is produced.

There is a need for a preferably full length and full width insole sized to accommodate the entire undersurface of a person's foot which is preferably built-in or non-removable from footwear, having a thermoplastic material layer which is heat-softenable by a built-in electric heater or heater member. There is a need for such footwear so that a purchaser can heat-soften the built-in insole, try on the footwear, form the impression, and then let the impression cool so as to provide custom-fitting footwear in a convenient and efficient manner.

SUMMARY OF THE INVENTION

Footwear is provided which comprises an upper, a flexible outsole, and an insole. The insole comprises a layer of thermoplastic material and a heater member, the heater member being capable of generating heat by being energized by electrical energy by connection to an electrical power source. The heater member is capable upon being energized of effectively heating and softening the thermoplastic material so that the insole may be conformed to the shape of the underside of a foot of a person.

BRIEF DESCRIPTION OF THE DRAWINGS

FIG. 4, is a perspective view of an insole of the present invention being made.

FIG. 5 is a partially-exploded view of an insole of the present invention.

FIG. 6 is a partially-exploded view of an insole of the present invention with an outsole and power source.

FIG. 7 is a perspective view of a half insole of the present invention in an outsole.

DETAILED DESCRIPTION OF THE PREFERRED EMBODIMENTS OF THE INVENTION

Figure 1:
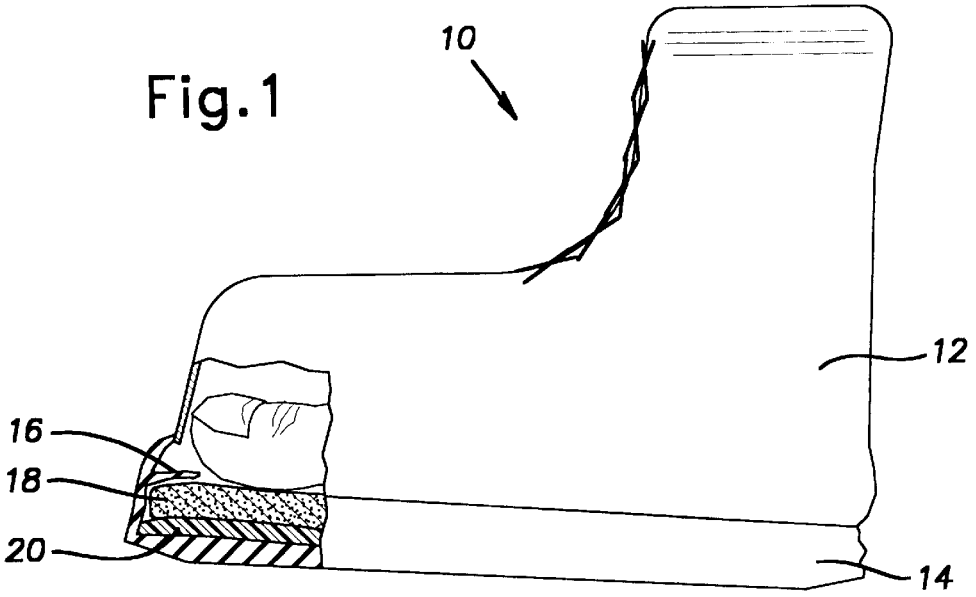
FIG. 1 is an elevational view of a hiking boot incorporating the present invention with part of the toe portion of the boot cut away showing art of the toe portion of the boot in cross section.
Figure 2A:
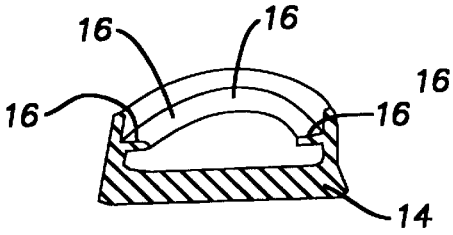
FIG. 2A is a cross sectional perspective view of the toe portion of the outsole of the boot of FIG. 1.
Figure 2:
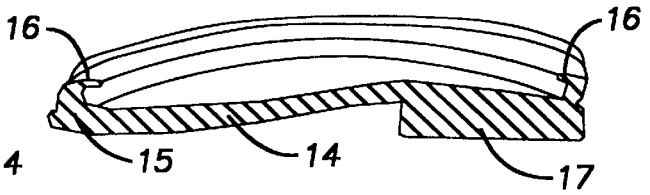
FIG. 2 is a cross sectional view, lengthwise, of the outsole of the boot of FIG. 1.

With reference to FIGS. 1–15, and more particularly FIG. 1, there is shown a boot or hiking boot 10 having an upper 12 and a flexible outsole 14, and an insole comprised of a thermoplastic material layer 18 and a heater or heater member 20. The outsole is flexible, that is, it bends when the wearer walks, and is made of materials known in the art. With reference to FIG. 2, the outsole 14 is shown lengthwise in cross section, having a toe end 15 and a heel 17. The outsole has a lip 16 around its entire interior perimeter. When the insole is heated by the heater as described hereinafter, the thermoplastic material in the insole is softened and stepped on by the person. This tends to squeeze the softened plastic and tends to force it around the person's foot and possibly up into the shoe or boot. The lip 16 overhangs the insole and functions to prevent any soft plastic from escaping or being forced into the upper part or interior of the shoe or boot. FIG. 2A further illustrates lip 16 being integrally molded around the interior perimeter of the outsole 14.

Figure 3:
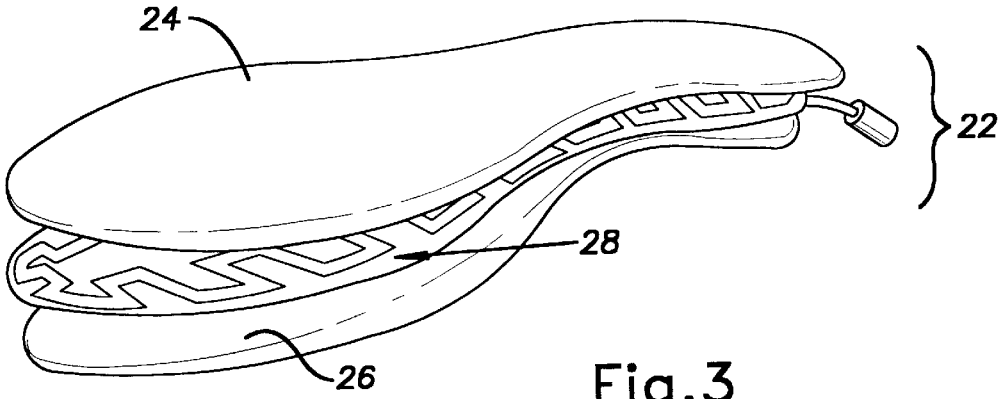
FIG. 3 is an exploded view of an insole of the present invention.

FIG. 3 illustrates the insole 22 which is flexible and resilient at 72° F. and which is preferably built-in and non-removable from the footwear, less preferably removable. The insole 22 is preferably comprised of a thermoplastic material layer 24, a second thermoplastic material layer 26, and a heater or heater member 28 sandwiched therebetween. As shown, these three layers are in the shape of an insole of a shoe or boot. When these three layers are pressed or attached or sealed together, they have a thickness of 1/32 to 1/4, more preferably 1/16 to 1/8, inch. The thermoplastic material layers are of a thermoplastic material which is heat softenable so that the insole is moldable or conformable to the shape of the underside of a foot of a person when the person stands on the heat-softened insole. Optionally, only one of the two layers 24, 26 may be utilized, preferably layer 24. A preferred thermoplastic material for use in the present invention includes several components, the first component being selected from the group consisting of ethylene copolymers, ethylene terpolymers and mixtures thereof; the second component being selected from the group consisting of ethylene terpolymers which are ethylene vinyl acetate modified by the addition of carbonyl groups; the third component being weight reducing fillers such as glass or plastic bubbles or microspheres or microbubbles or microballoons (these being preferred), ground cork, ground foam rubber, Cabosil, and rice hulls, and a fourth component of plasticizers preferably epoxidized soybean oil or from the phthalate family. These latter two components modify the material with relation to weight and hardness. Preferred thermoplastic materials are described more specifically as follows.

The thermoplastic material, which is solid at 80° F., is preferably the following formulation:

1. 45–95, more preferably 50–90, more preferably about 75–85, more preferably about 80, weight percent ethylene vinyl acetate (EVA)
2. 10–40, more preferably 15–25, more preferably about 18, weight percent modified EVA
3. 0.5–15, more preferably 1.5, more preferably about 2, weight percent polyoctenamer rubber.
4. 0.5–3, more preferably about 1.5, weight percent dry expanded plastic microspheres, such as Expancel 091DE from Expancel, Inc. of Duluth, Ga.
5. 0.25–1.5, more preferably about 0.5, weight percent epoxidized soybean oil as a plasticizer.

Less preferably the formulation is:

1. 45–95, more preferably 50–90, more preferably about 75–85, weight percent EVA
2. 10–40, more preferably 15–25, more preferably about 18, weight percent modified EVA.
3. Effective amounts of weight-reducing filler and plasticizer, such as noted above.

Component No. 1 above (EVA) is preferably Product AT 2850M from AT Plastics Inc., Brampton, Ontario, Canada, is preferably 28% vinyl acetate, less preferably 24 to 33% vinyl acetate, preferably has a relatively low molecular weight (approximately 14,000 to 26,000 weight average), preferably has a relatively high melt index (preferably 850, less preferably 400 to 1000, dg/min.), preferably has a ring and ball softening point of about 150–170° F., more preferably 160° F., and preferably has a specific gravity of 0.96 or less. It can be in pellet or powder form. Product AT 2850M has a tensile strength of 200 psi, 190% elongation at break, a flexural modulus 1% secant of 1060 psi, a Shore A hardness of 67, a ring and ball softening point of 169° F., a melt temperature of 149° F., and a specific gravity of 0.944. One advantage of EVA is its low cost.

The modified EVA is preferably Elvaloy 741, less preferably Elvaloy 742. Both are an ethylene terpolymer and both are ethylene vinyl acetate modified by the addition of carbonyl groups, said carbonyl groups being incorporated as part of the main chain. The phrase ethylene terpolymers which are ethylene vinyl acetate modified by the addition of carbonyl groups as used herein includes Elvaloy 741 and 742. Elvaloy 741 is compatible with EVA, lowers the softening point of the EVA, increases and controls viscosity, increases flexibility, and enhances resistance to perspiration, body oils, and microbial growth. It is available from DuPont and has a molecular weight of greater than 250,000, a specific gravity of 1, tensile strength of 860 psi, 950% elongation at break, an elastic modulus of 1150 psi, a melt index of 35–40, a ring and ball softening point of 106° C., a crystalline melting temperature of 151° F., and a Shore A durometer hardness of 70. It can be used in pellet or powder form. Sufficient modified EVA is added to lower the softening point to the desired range but also to provide a thermoplastic material in which an effective impression can be made while not detrimentally affecting the other desired performance characteristics. Ethylene vinyl acetate modified by the addition of carbonyl groups is believed to have unique properties as described above which make it particularly useful in the present invention.

The polyoctenamer rubber is preferably trans-polyoctenamer rubber, available as Vestenamer 6213 from Huls America Inc., Piscataway, N.J. It has a whole polymercyclic structure. It has a melting point of approx. 86° F., specific gravity of 0.89, an average molecular weight of 120,000 with a very broad molecular weight distribution, a viscosity at 23° C. of 120–140 ml/g, a Mooney viscosity ML (1+4) 100° C. of less than 10, and a melt index MFI 190° C./2.16 kg of 3.5. It enhances the heat stability of the thermoplastic material and also enhances extrusion of the product.

The weight-reducing fillers and plasticizers are as described above.

So long as a sufficiently low softening point for the overall thermoplastic material is achieved, other ethylene copolymers and/or terpolymers or mixtures thereof can be substituted, in whole or in part, for the ethylene vinyl acetate, including ethylene methyl acrylate, ethylene ethyl acrylate, ethylene butyl acrylate, and ethylene vinyl acetate acid terpolymer such as ELVAX 4310 from DuPont.

As used herein, non-foam means non-blown. Preferably, the thermoplastic material has a ring and ball softening point of 140°–200° F., more preferably 165°–190° F., more preferably about 175°–190° F., has a melting point of 145° to 165° F., has a melt index of 1.5 to 5 g per 10 min. (90° C., 1082 g load), has a consistency at 160° F. approximately like masticated chewing gum so that an effective impression of the foot, can be made, and has the following physical characteristics at 72° F. or other standard conditions: Shore A hardness of 50–80, preferably 55–70, tensile strength of 100–500 psi, flexibility of 3–7, more preferably 4–6, more preferably about 5 (measured at room temperature on a flexometer having a scale of 0 to 10 and operating at 300 cycles per minute), elongation at break of 50–400 percent, and for lightness a specific gravity of less than 1, more preferably less than 0.8, more preferably less than 0.7, more preferably about 0.6. It is non-foam with microspheres or microbubbles or microballoons as weight-reducing filler and is non-blown and can be softened and remolded multiple times without loss or significant or substantial loss of its function or physical characteristics and preferably can be conformed to the underside of a person's foot while at 140°–200° F., more preferably 150°–170° F., more preferably about 160° F. It resists compression. Low density and light weight are desirable characteristics for insoles and footwear. To provide sufficient structural support at stress points under the person's foot and to avoid permanent compression and resist compression, the thermoplastic material has a specific gravity of at least 0.25, more preferably at least 0.3, more preferably at least 0.4, more preferably at least 0.5, more preferably at least 0.55.

Figure 8:
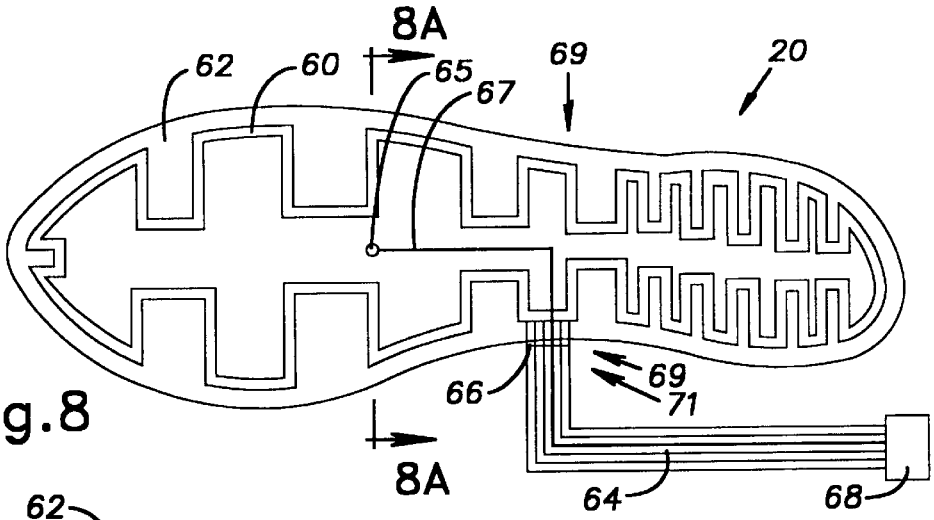
FIG. 8 is a plan view of a heater of the present invention.
Figure 8A:
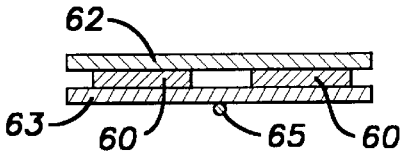
FIG. 8A is a sectional view taken along line 8A—8A of FIG. 8.

With reference to FIGS. 8 and 8A, a heater or heater member 20 is shown, having an etched foil heating element 60 sandwiched between top and bottom layers 62 and 63 of insulation or insulating sheath material. The etched foil heating element 60 is preferably provided by acid etching a circuit in a 0.001 inch (0.025 mm) thick nickel resistance alloy foil. The etched foil element has excellent circuit pattern repeatability and superior heat transfer, which results from greater area coverage of the element. The sheath material layers 62 and 63 are preferably Mylar brand polyester film or Kapton, a thin lightweight transparent material from DuPont. A preferred heater or heater member 20 may be obtained from Watlow, St. Louis, Mo. Less preferably, the sheath material layers 62, 63 may be silicon rubber or neoprene. Less preferably, the heating element may be a wire-wound element, such as is created by spiraling fine resistance wires around a fiberglass cord. The wire-wound element is laid out in a pattern to provide effective heat distribution. These heaters are also available from Watlow. An alternative heating element includes a nichrome or copper wire heating element available from Watlow. Less preferably, the heater or heater member 20 may be an electrically conductive polymeric layer having sufficient electrical resistance to generate an effective amount of heat.

The heater 20 may be embedded into or adhered onto the thermoplastic material layer in a variety of ways. A diecut layer of thermoplastic material may be laid into a cavity, having a thickness of 1/16 inch on top of which is placed the heater which is in the same shape as the thermoplastic material layer and another identical thermoplastic material layer laid on top of the heater creating a sandwich as shown in FIG. 3. Alternatively, a single layer of thermoplastic material may have the heater on top or underneath the thermoplastic material layer. Alternatively, as shown in FIG. 4, the heater 20 may be placed into a die 32 and molten thermoplastic polymer material 34 is placed into the die on top of the heater 20; conversely, molten thermoplastic material can be pumped into a die and the heater placed on top of the molten polymer. A preferred insole 36 is shown in FIG. 5, comprised of a combination thermoplastic material/heater layer 38 over which is provided a layer 40 of closed cell urethane foam, such as available from Rogers Corporation in East Woodstock, Conn. A top cover layer 42 is then provided to cover the entire component upon which the foot would rest, the top cover being preferably a moisture wicking fabric such as available from Faytex in Weymouth, Mass. The closed cell urethane foam is provided for cushioning and to insulate the foot from the heat of the thermoplastic material.

As shown in FIG. 6, a premolded outsole or outsole/midsole combination 46 (shown without preferred lip 16) has a recess into which is placed an insole 44 of the present invention having an electrical connection plug or electrical connector 48 connected to the heater in the insole by a wire 50. The plug 48 is adapted and constructed so that it may be electrically connected to an electrical power source by receiving an electrical connector 56 which is connected to a power box 52 which may be plugged into an electric outlet by plug 54. Plug 48 snap fits in a recess or plug port 49 molded into the back of the outsole 46. Alternatively the plug 48 can be placed at other locations along the perimeter of the outsole, preferably near the heel or instep or on the outside opposite the instep.

Similarly to FIG. 6, FIG. 7 shows a half insole 58 for the heel portion only laid into an outsole 46.

Figure 9:
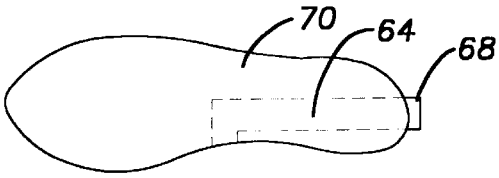
FIG. 9 is a plan view of an insole incorporating the heater of FIG. 8.

With reference to FIG. 8, the heater 20 is preferably provided with a plug tab 64 so that the etched foil heating element 60 may be electrically connected through the plug tab to the electrical connection plug 68, which is similar or identical to plug 48. Thus, electrical energy can flow through plug 68, through electrical conductors or wires in plug tab 64 to the etched foil heating element 60. The plug tab 64 exits adjacent to the heater 20 so that the etched foil heating element can heat right up to the edge of the insole. A crease or fold 66 is provided so that when the heater 20 is embedded in or sandwiched between the thermoplastic material layers such as 24, 26, the plug tab 64 may be folded underneath the insole, as shown in FIG. 9. With the plug tab 64 being attached in the instep or medial arch area 71 (at the waist 69, 69 of the heater as shown in FIG. 8) and folded underneath the insole 70, the insole 70 may be much more easily assembled into the boot or shoe. The plug tab 64 provides 3 or 4 inches of extra loose extension material so that during assembly of the footwear, the plug 68 may be snap fit into a recess in the outsole and the insole 70 may be placed within the outsole. Having three or four inches of plug tab material makes it easier to bend the insole and assemble it into the outsole. Thermocouple 65 is attached to the heater 20 on the outside of layer 62 or layer 63, or is located between layers 62 and 63, or is embedded in the thermoplastic material layer, and is connected by wire 67 through plug tab 64 to plug 68. Thermocouple 65 measures or senses the temperature of the thermoplastic material which is being heated by heater 20 and operates through an appropriate control in plug 68 or power box 52 to cut off or reduce electric power to heater 20 when a preselected softening temperature of the thermoplastic material is reached. Other means known in the art may be used to monitor the temperature of the thermoplastic material and to reduce or turn off the electric power at an appropriate temperature. For example, HISS technology may be used, which controls the heater without use of a thermocouple. It sends an electric signal or pulse through the foil circuit and measures electrical resistance which is a function of temperature and thereby can control the temperature through a control unit connected to the power source. The heater 20 is preferably in contact with the adjacent thermoplastic material layer or layers.

Figure 10:
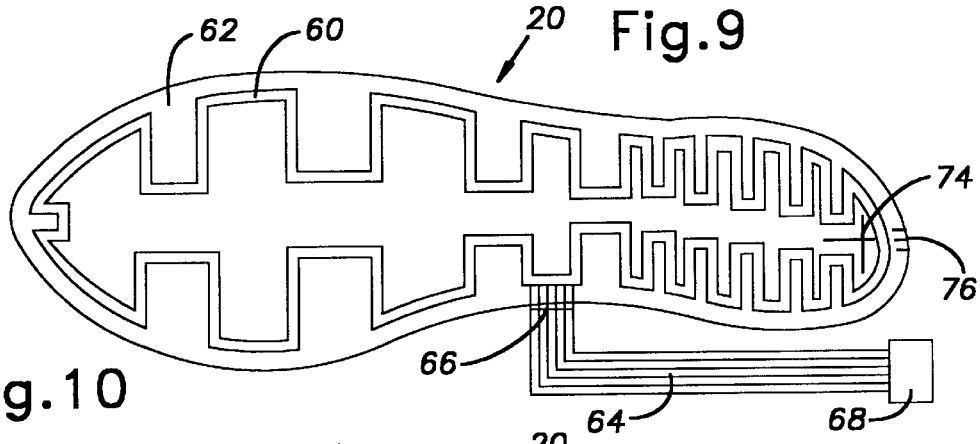
FIG. 10 is a plan view of an alternative embodiment of a heater.
Figure 11:
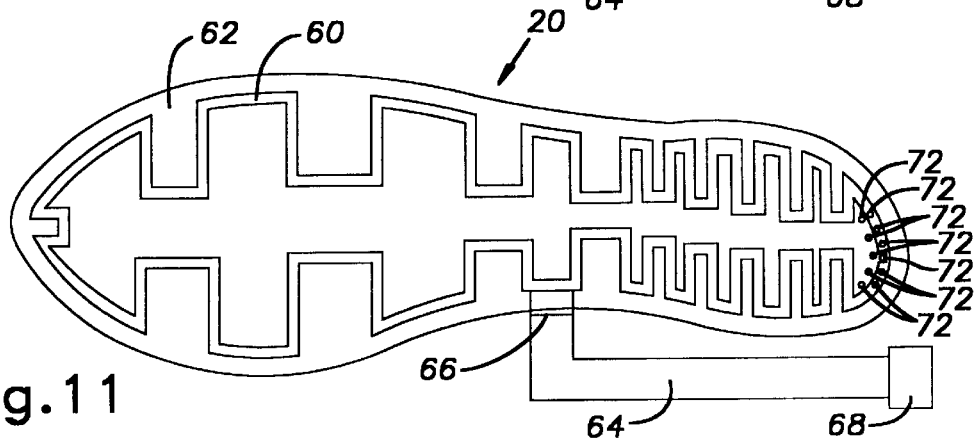
FIG. 11 is a plan view of an alternative embodiment of a heater.

With reference to FIG. 10 a heater 20 is shown having slices 74 and slices or cuts 76 cut through the insulating sheath material layers 62, 63. Slices, cuts and holes are all perforations. These slices or cuts will permit heat-softened thermoplastic material to flow therethrough or be forced therethrough when the person is standing on the insole, to more effectively reach the plug area so that the plug may more effectively be sealed in the plug port of the outsole into which it is snap-fit. This will help keep moisture out of the footwear. Heat activated glue may also be used to seal the plug in the plug port. In FIG. 11, holes 72 are shown through layers 62, 63 and also through heating element 60; melted polymer may flow through these holes for the same purpose that melted polymer flows through the slices or cuts in FIG. 10. If the insole has a covering enclosing the thermoplastic material, similar slices, cuts or holes through the cover may be provided for the same purpose.

Figure 12:
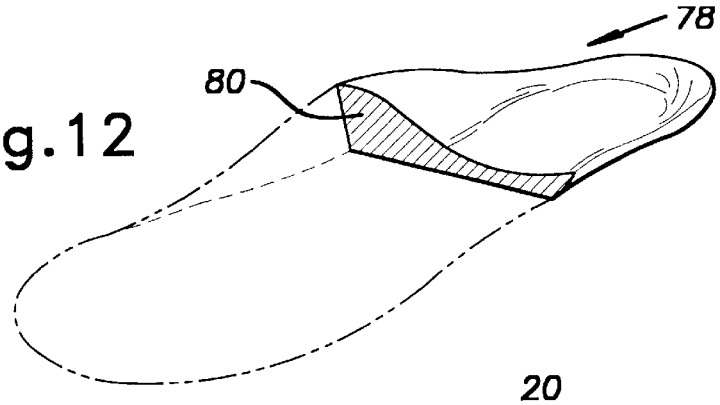
FIG. 12 is a perspective view, with the front half cut away, of an insole.
Figure 13:
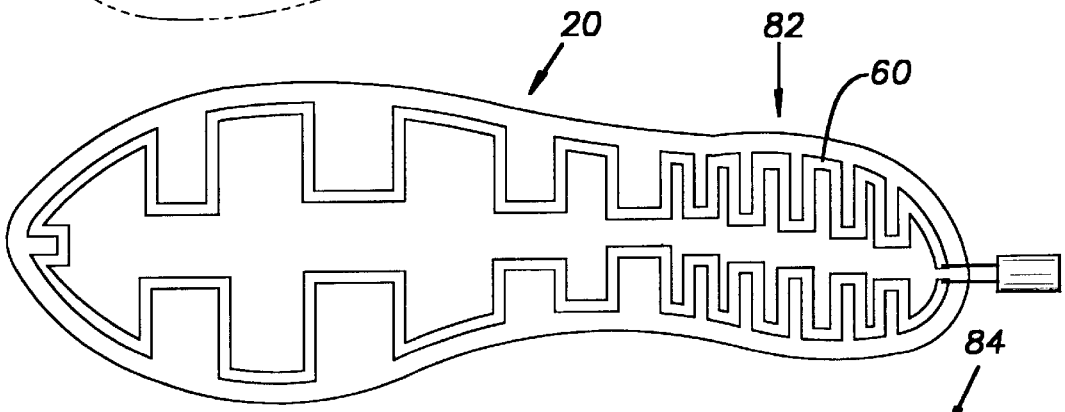
FIG. 13 is a plan view of a heater.

As shown in FIG. 12, the thickness and shape of the thermoplastic material layer can be varied to accommodate formability options, for example, a thicker portion or layer 80 of thermoplastic material in insole 78 in the medial portion may be provided to aid a pes planus pronation. Similarly, the construction of the heater can be modified to adapt to similar situations. More heat can be applied to a specific region to allow for a deeper impression in a shorter period of time by concentrating the etched foil heating element in one area, such as the heel area 82 of heater 20 shown in FIG. 13. This would be appropriate in the case of forming a deep heel cup to aid in calcaneal cushioning.

Figure 14:
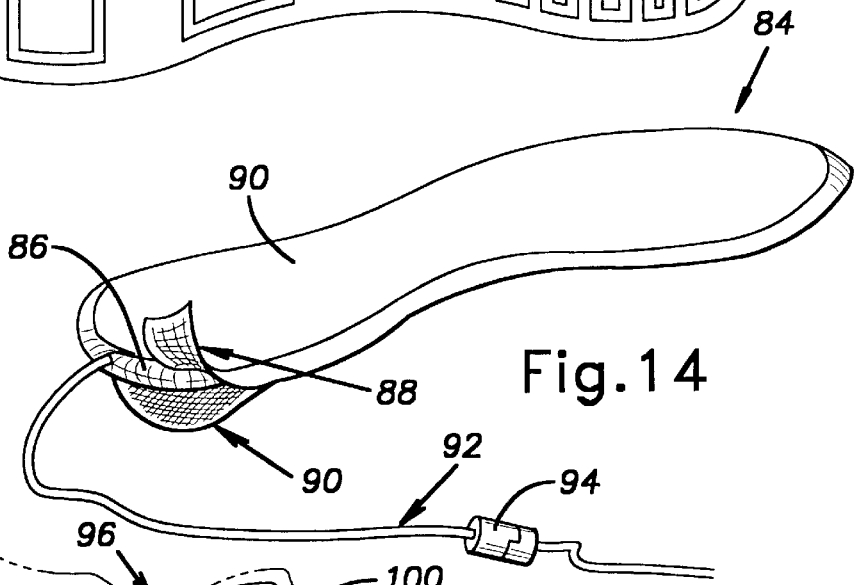
FIG. 14 is a perspective view of a removable insole according to the invention, with part of the cover pulled away.

The insole may less preferably be removable, as shown in FIG. 14, where removable insole 84 is shown with the heater encased in thermoplastic material 86 being covered on the top and bottom with urethane coated fabric 90 and sewn around the perimeter with coated nylon bias 88 such as available from National Bias Company in Cleveland, Ohio. Thus the sewn covering may hold the heater in contact with the thermoplastic material layers; alternatively, the heater may be adhesively attached or otherwise attached or sealed to or within the thermoplastic material layer or layers. As shown in FIG. 14, the heater of a removable insole may be provided with a flexible wire 92 connected to a plug 94 for connection to an electrical power source; the cord or wire is approximately 6 inches in length attached at the rear of the insole so as not to hinder the normal gait of the wearer and to increase the comfort level. If the wire and/or plug are uncomfortable, the wire may be snipped where it emerges from the insole after the insole has been molded to the shape of the person's foot.

Figure 15:
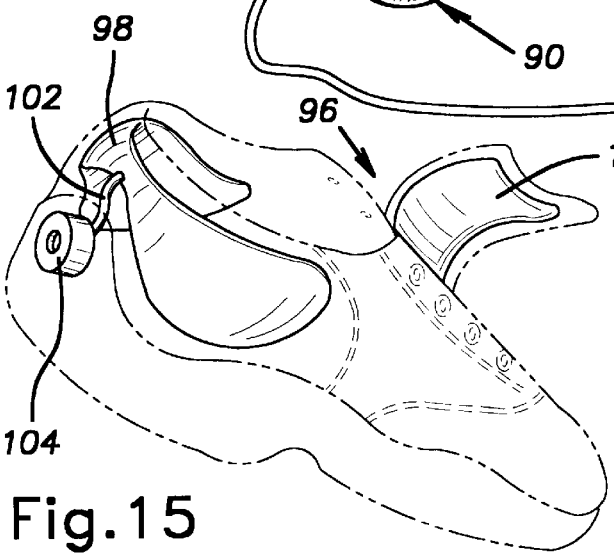
FIG. 15 is a perspective view of a shoe incorporating an embodiment of the invention, with exterior portions of the heel box of the shoe removed.

FIG. 15, which shows a less preferable construction, shows a shoe 96 having a conforming member 98 in the heel box surrounding the sides of the heel of the wearer. For electrical connection, the conforming member 98 has a wire 102 connected to an electrical connection plug 104. The conforming member 98 is constructed as described above. In a similar manner, a conforming member 100 may be provided in the tongue of the shoe. These members can be sewn or otherwise attached in the appropriate places of the footwear. The present invention is preferably utilized in a shoe or boot intended for ambulatory locomotion, such as walking and hiking shoes and boots, preferably a walking shoe, an athletic shoe, and a dress shoe, less preferably a hiking boot. The invention can even less preferably be used in an inline skate or even less preferably in a ski boot. The invention can be used to adjust to the unique contours of the structure of the foot in the various places where the foot contacts the footwear, preferably the bottom of the foot.

To provide custom-fitting footwear, such as a boot, according to the invention, the heater is energized with electric power so that electrical resistance materials in the heater will generate heat, which softens the adjacent thermoplastic material. The person then steps into the boot and steps down on the insole to conform the insole to the shape of the underside of their foot. The thermoplastic material is then permitted to cool and harden, thus providing a custom-fitting footbed and a flexible, resilient insole custom-fitted to the underside of the person's foot. If the person wants to change the fitting, the thermoplastic material may simply be reheated and re-conformed.

The electric power source and thermocouple are controlled so that the thermoplastic material is heated up by the heater to a temperature preferably in the range of 130° F.–180° F. In addition, the power source provides sufficient energy to bring the thermoplastic material up to temperature within a preselected time frame, preferably less than 10 minutes, more preferably less than 5 minutes. The final preselected temperature is then maintained by use of the built-in thermocouple, the thermocouple controlling the electrical power so as to maintain the preselected temperature.

The insole with heater assembly can less preferably be utilized in specified areas within the sole of the shoe, for example, the arch area only or the heel portion only.

Optionally, a battery pack can be attached to the person or the footwear, the battery pack being electrically connected to the plug 48 or the heater 20 and equipped with a controller and/or thermocouple to control the amount of electrical power supplied to the heater 20, a sufficiently small amount of DC electric power being supplied so that the insole is merely warmed but not softened. By this way, the footwear can warm the foot of the wearer during cold weather.

Although the preferred embodiments of this invention have been shown and described, it should be understood that various modifications and rearrangements of the parts may be resorted to without departing from the scope of the invention as disclosed and claimed herein.

What is claimed is:

1. Footwear comprising an upper, a flexible outsole, and an insole, said insole comprising a layer of thermoplastic material and a heater member, said footwear further comprising an electrical connector connected to said heater member, said heater member being capable of generating heat by being electrically energized by electrical connection to an electrical power source, said electrical connection of said heater member to said electrical power source being via an electrical conductor, said heater member being capable upon being energized of effectively heating and softening said thermoplastic material so that said insole may be conformed to a shape of the underside of a foot of a person.

2. The footwear of claim 1, wherein said heater member is sandwiched between two layers of thermoplastic material.

3. The footwear of claim 1, wherein said heater member comprises an etched foil heating element.

4. The footwear of claim 3, wherein said etched foil heating element comprises nickel resistance alloy foil.

5. The footwear of claim 1, wherein said outsole includes a lip which overhangs said insole.

6. The footwear of claim 1, said insole further comprising a thermocouple unit capable of controlling electric energy supplied to said heater member and capable of controlling the temperature to which said heater member may heat said thermoplastic material.

7. The footwear of claim 1, said heater member having a heel end and being connected to a plug in a plug port, said heater member having perforation near said heel end to permit softened thermoplastic material to flow toward said plug in said plug port.

8. The footwear of claim 1, said footwear having a heel portion, said heater member having a waist and having a plug tab extending from said waist, said plug tab terminating in a plug located in said heel portion.

9. The footwear of claim 8, said heater member having a medial arch area at said waist, said plug tab extending from said medial arch area.

10. The footwear of claim 1, wherein said footwear is selected from the group consisting of walking shoes, athletic shoes, dress shoes, and hiking boots.

11. The footwear of claim 10, wherein said footwear is selected from the group consisting of hiking boots.

12. The footwear of claim 10, wherein said footwear is selected from the group consisting of walking shoes.

13. The footwear of claim 1, wherein said layer of thermoplastic material comprises weight-reducing filler.

14. The footwear of claim 1, further comprising a battery pack electrically connected to said heater member and being capable of supplying electrical energy to said heater member so as to effectively warm said insole without softening said thermoplastic material.

15. The footwear of claim 1, wherein said thermoplastic material is non-foam.

16. The footwear of claim 1, wherein said electrical connector is an electrical connection plug.

17. The footwear of claim 1, wherein said electrical conductor includes a wire.

18. The footwear of claim 1, wherein said heater member is disposed between said layer of thermoplastic material and said outsole.

19. The footwear of claim 1, wherein said heater member comprises a layer of polyester film.

20. The footwear of claim 1, wherein said footwear is selected from the group consisting of shoes.

21. The footwear of claim 20, wherein said heater member is disposed between said layer of thermoplastic material and said outsole.

22. The footwear of claim 21, wherein said layer of thermoplastic material comprises weight-reducing filler.

23. The footwear of claim 22, wherein said footwear is selected from the group consisting of walking shoes.

24. The footwear of claim 1, said thermoplastic material having a specific gravity of fat least 0.25.

25. The footwear of claim 1, said thermoplastic material having a specific gravity of at least 0.4.

26. The footwear of claim 25, said thermoplastic material having a specific gravity less than 0.8.

* * * * *

UNITED STATES PATENT AND TRADEMARK OFFICE

CERTIFICATE OF CORRECTION

PATENT NO. : 5,829,171

DATED : November 3, 1998

INVENTOR(S) : William H. Weber, et al.

It is certified that error appears in the above-indentified patent and that said Letters Patent is hereby corrected as shown below:

On the title page, item [56], under References Cited, U.S. Patent Documents, please add the following:

| | | | |
|---|---|---|---|
| 1,691,472 | 11/1928 | Graham, et al. | 36 2.6 |
| 2,025,950 | 12/1935 | Kurtz | 36 2.6 |
| 3,905,376 | 9/1975 | Johnson, et al. | 36 154 |
| 3,906,185 | 9/1975 | Gross, et al. | 36 2.6 |
| 5,203,793 | 4/1993 | Lyden | 36 93X |

Column 1, line 66, "art" should be --part--.

Column 3, line 31, "1.5," should be --1-5,--.

Column 8, line 40, "perforation" should be --perforations--.

Column 10, line 6, "fat" should be --at--.

On the title page, above [51] References Cited add the following heading:
-- [60] Related U.S. Application Data
Provisional application No. 60/027,175, OCt. 1, 1996. --

Signed and Sealed this

Twenty-seventh Day of April, 1999

*Attest:*

Q. TODD DICKINSON

*Attesting Officer*

*Acting Commissioner of Patents and Trademarks*